US006681577B2

(12) United States Patent
Bolender et al.

(10) Patent No.: US 6,681,577 B2
(45) Date of Patent: Jan. 27, 2004

(54) METHOD AND APPARATUS FOR RELIEVING STRESS IN A COMBUSTION CASE IN A GAS TURBINE ENGINE

(75) Inventors: Lynn Marie Bolender, West Chester, OH (US); Jeffrey John Eschenbach, Loveland, OH (US); Edward Patrick Brill, West Chester, OH (US); Robert Eugene Uhl, Middletown, OH (US); Michael William Hamilton, West Chester, OH (US); Steven Jerome Longtin, West Chester, OH (US)

(73) Assignee: General Electric Company, Schenectady, NY (US)

( * ) Notice: Subject to any disclaimer, the term of this patent is extended or adjusted under 35 U.S.C. 154(b) by 31 days.

(21) Appl. No.: 10/050,255

(22) Filed: Jan. 16, 2002

(65) Prior Publication Data

US 2003/0131603 A1 Jul. 17, 2003

(51) Int. Cl.[7] ..... F02G 1/00
(52) U.S. Cl. ..... 60/772; 60/754
(58) Field of Search ..... 60/752–760, 772

(56) References Cited

U.S. PATENT DOCUMENTS 3,899,882 A * 8/1975 Parker ..... 60/752
3,990,837 A * 11/1976 Snell ..... 60/752
4,004,056 A * 1/1977 Carroll ..... 428/593
4,008,568 A * 2/1977 Spears et al. ..... 60/796
4,180,972 A 1/1980 Herman et al. ..... 60/39.32
4,191,011 A 3/1980 Sweeney et al. ..... 60/39.32
4,244,178 A * 1/1981 Herman et al. ..... 60/754
4,269,032 A * 5/1981 Meginnis et al. ..... 60/754
4,296,606 A * 10/1981 Reider ..... 60/754
4,302,940 A * 12/1981 Meginnis ..... 60/754
4,312,186 A * 1/1982 Reider ..... 60/754
5,323,601 A 6/1994 Jarrell et al. ..... 60/39.31
5,687,572 A * 11/1997 Schrantz et al. ..... 60/753
6,254,334 B1 7/2001 LaFleur ..... 415/115
6,449,952 B1 * 9/2002 Emilianowicz et al. ..... 60/772

* cited by examiner

*Primary Examiner*—Justine R. Yu
*Assistant Examiner*—William Rodriguez
(74) *Attorney, Agent, or Firm*—Nathan D. Herkamp; Gregory A. Welte

(57) ABSTRACT

A combustion case for a gas turbine engine. A typical combustion case is generally cylindrical or conical. Apertures penetrate the case, from the outer surface, through the case, to the inner surface. The apertures act as concentration points for stress. To dissipate the stress, bosses buttress the apertures, with each aperture having two bosses: one on the outer surface of the case, and another on the inner surface of the case. The invention eliminates the latter bosses. The invention dissipates stress by providing an array of T-slots on the inner surface.

20 Claims, 7 Drawing Sheets

METHOD AND APPARATUS FOR RELIEVING STRESS IN A COMBUSTION CASE IN A GAS TURBINE ENGINE

FIELD OF THE INVENTION

The invention relates to stress reduction in combustion cases in gas turbine engines.

BACKGROUND OF THE INVENTION

FIG. 1 illustrates the outer surface of a segment 3 of a combustor case used in a gas turbine engine. The overall case is generally cylindrical, or conic, and the conic/cylinder is formed by extending segment 3 around axis 6, as indicated by arrows 9. FIG. 2 illustrates the inner surface 12 of the segment 3 of FIG. 1.

Apertures or holes 15 are formed within the case, for various purposes, such as delivery of fuel to combustors (not shown) within the case. The apertures penetrate the case in regions where the material of which the case is constructed is dimensionally thin. The thin material provides a less-than-optimal attachment point for external structures, such as a fuel-delivery tube. Further, the apertures themselves act as stress-risers, and increase stress concentrations in the already thin material surrounding them.

In order to dissipate the stress concentrations, strengthen the region surrounding the apertures 15, and to provide a convenient flange for attachment of tubing or sensors, bosses 18 are provided. FIG. 3 illustrates a boss 18 in schematic, cross-sectional view.

Traditionally, as indicated in FIGS. 1 and 2, a separate boss 18 is provided for each individual aperture 15. Further, for each aperture, two bosses are provided: a boss 18 on the outer surface, as in FIG. 1, and a boss 18 on the inner surface, as in FIG. 2.

The individual bosses on the inner surface increase manufacturing costs. In one manufacturing approach, a complex milling set-up must be used, partly because the diameter of the case is small compared with the size of an ordinary vertical mill. In another approach, Electro Chemical Machining, ECM, is used.

It is desired to eliminate, or reduce, the complexity and expense of the traditional approach to manufacturing the case of FIGS. 1 and 2.

SUMMARY OF THE INVENTION

In one form of the invention, individual bosses for individual apertures on the inner surface of a combustion case are eliminated, and replaced by a continuous circumferential band having a thickness similar to that of the eliminated bosses. A circumferential array of T-shaped slots is generated within the band, on the inner surface of the case. These T-shaped slots separate the continuous band into individual areas of reinforcement bosses, each of which surrounds multiple apertures.

DETAILED DESCRIPTION OF THE INVENTION

Figure 4:
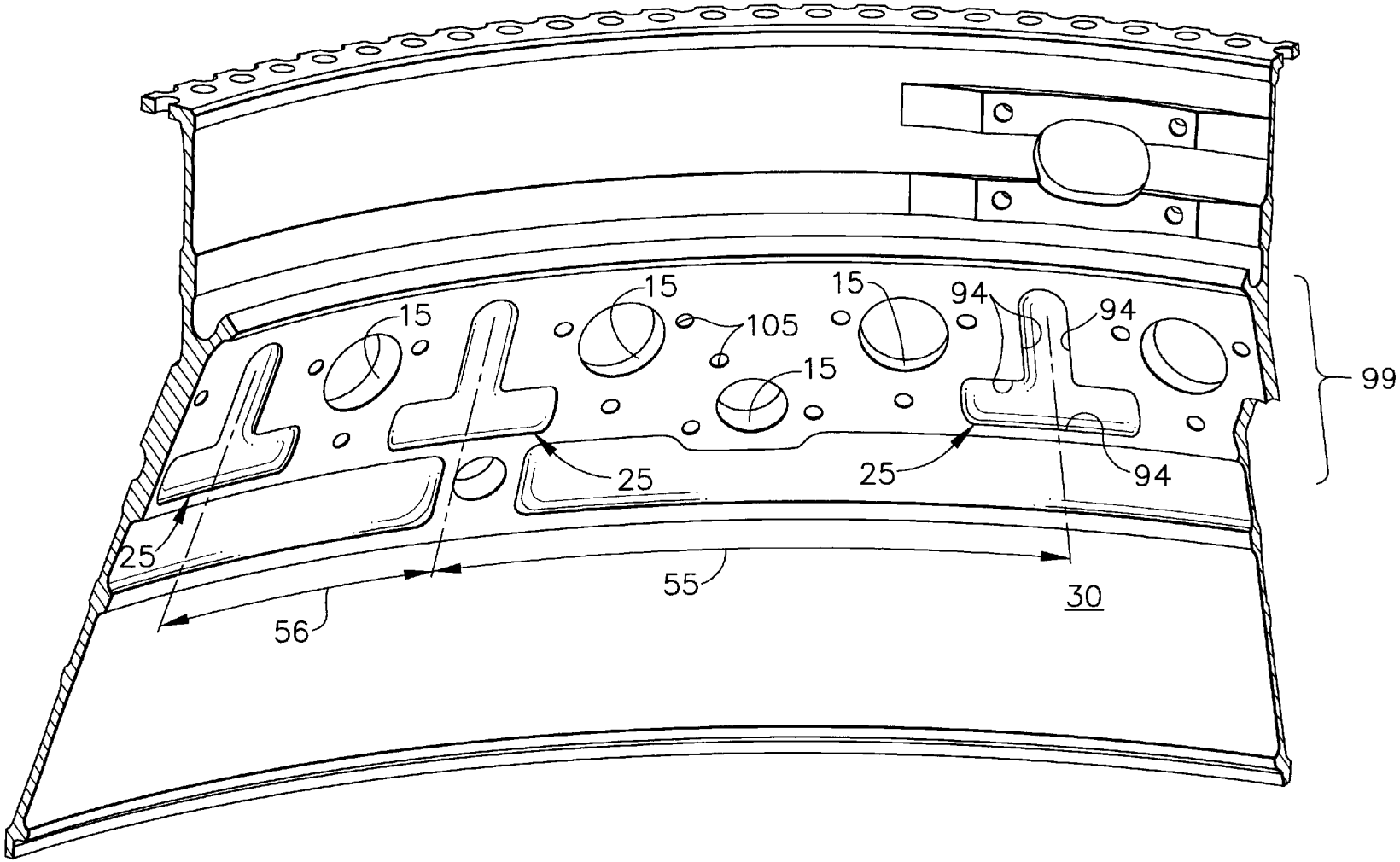
FIG. 4 illustrates one form of the invention.

FIG. 4 illustrates one form of the invention. T-shaped slots, or T-slots, 25 are cut into the inner surface, or inner face, 30 of the casing. As FIG. 5 indicates, the T-slot 25 does not fully penetrate the casing, but the outer surface, or face, 35 remains intact.

Figure 5:
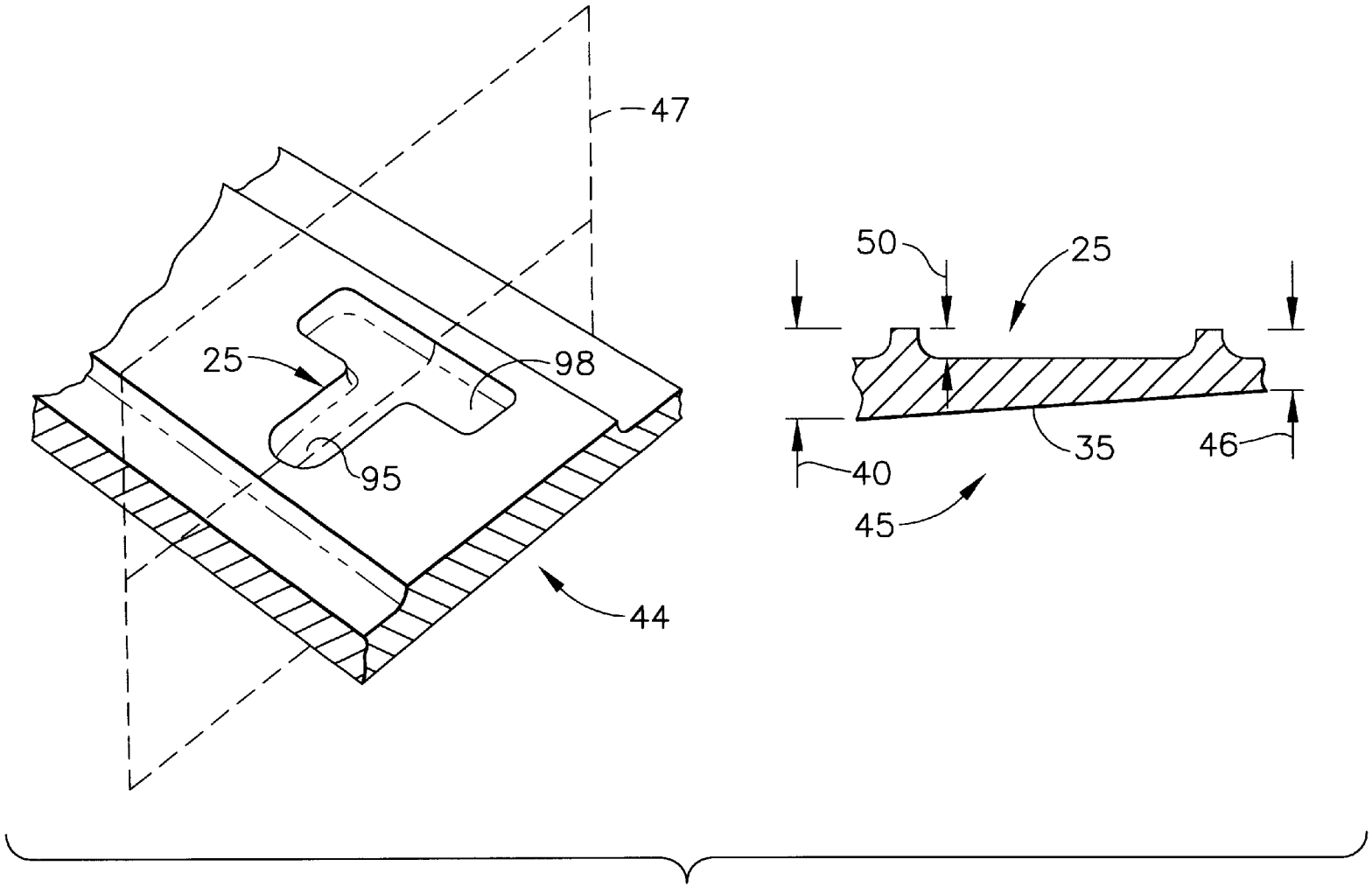
FIG. 5 contains a magnified view 44 of a T-slot 25 of FIG. 4, and a cross-sectional view 45 of the T-slot 25, as cut by plane 47.

Generalized dimensions of FIG. 5 are the following: dimension 40, representing the thicker region of the case wall; dimension 46, representing the thinner region of the case wall dimension 50, representing the depth of the T-slot. The T-slot 25 need not have uniform depth.

Figure 2:
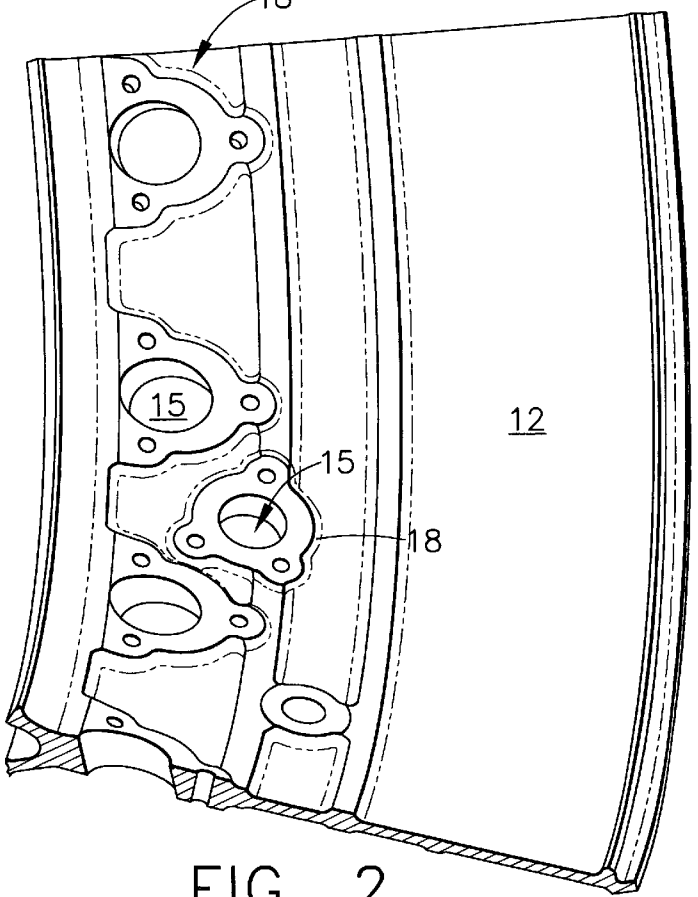
FIG. 2 (PRIOR ART)
FIG. 2 is a perspective view of the inner surface of the segment of FIG. 1.
Figure 6:
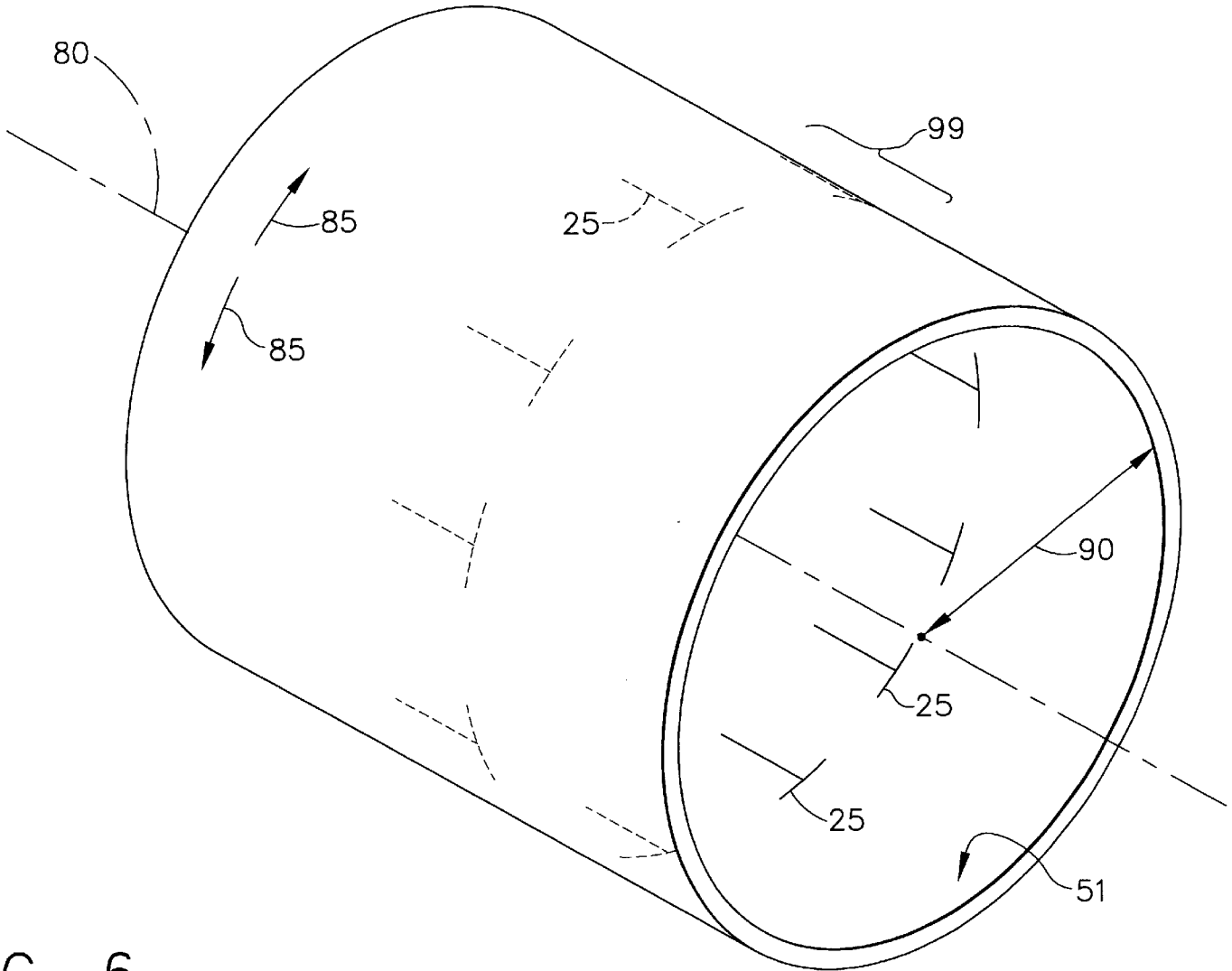
FIG. 6 illustrates, in schematic form, a circumferential array of T-slots, according to one form of the invention.

An array of the T-slots 25 is provided along the inner circumference 51 of the case, as schematically shown in FIG. 6. Preferably, no bosses of the type 18 in FIG. 2 are contained on the inner circumference in FIG. 6. The inner circumference is smooth, in the area of the apertures 15, with the exception of the T-slots 25 and the apertures 15 and 105 in FIG. 4.

From one point of view, in one form of the invention, the T-slots 25 in FIG. 4 divide the inner surface of the case into individual bosses, one of which is indicated as 55. That boss 55 contains three apertures 15, as opposed to the situation in FIGS. 1 and 2, wherein each individual boss 18 contains its own, single aperture 15.

Figure 1:
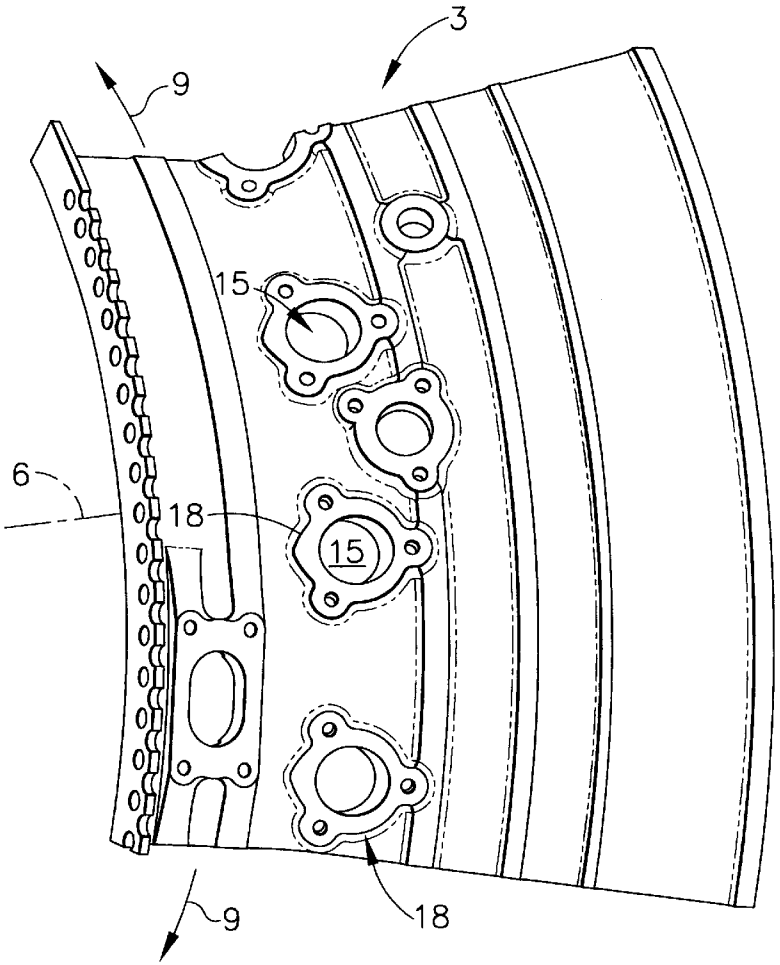
FIG. 1 (PRIOR ART)
FIG. 1 is a perspective view of the outer surface of a segment of a combustion case for a gas turbine engine.
Figure 3:
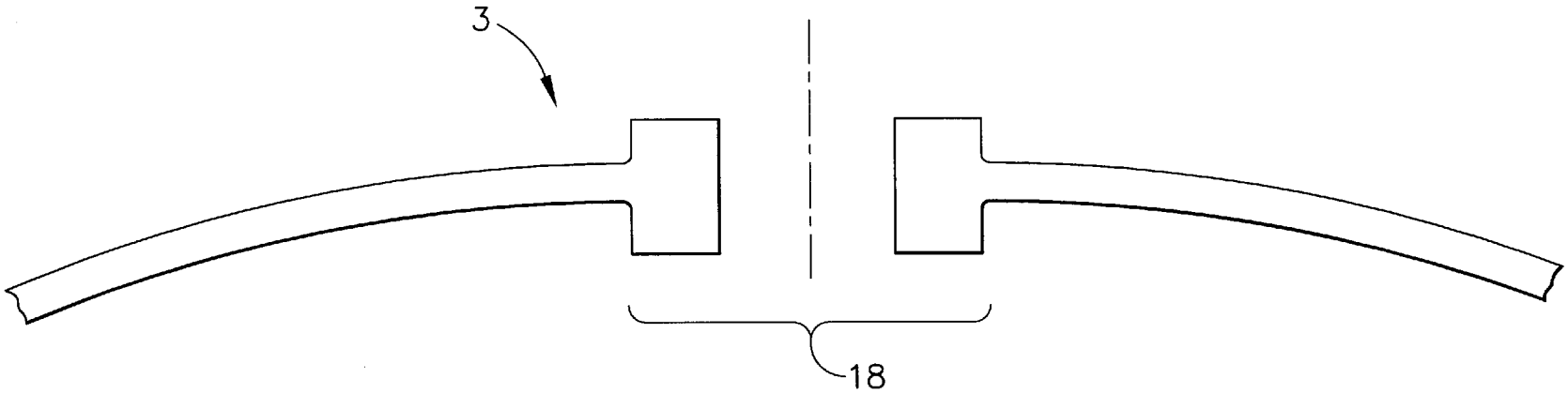
FIG. 3 (PRIOR ART)
FIG. 3 illustrates a boss 18 of FIGS. 1 and 2 in schematic, cross-sectional view.
Figure 8:
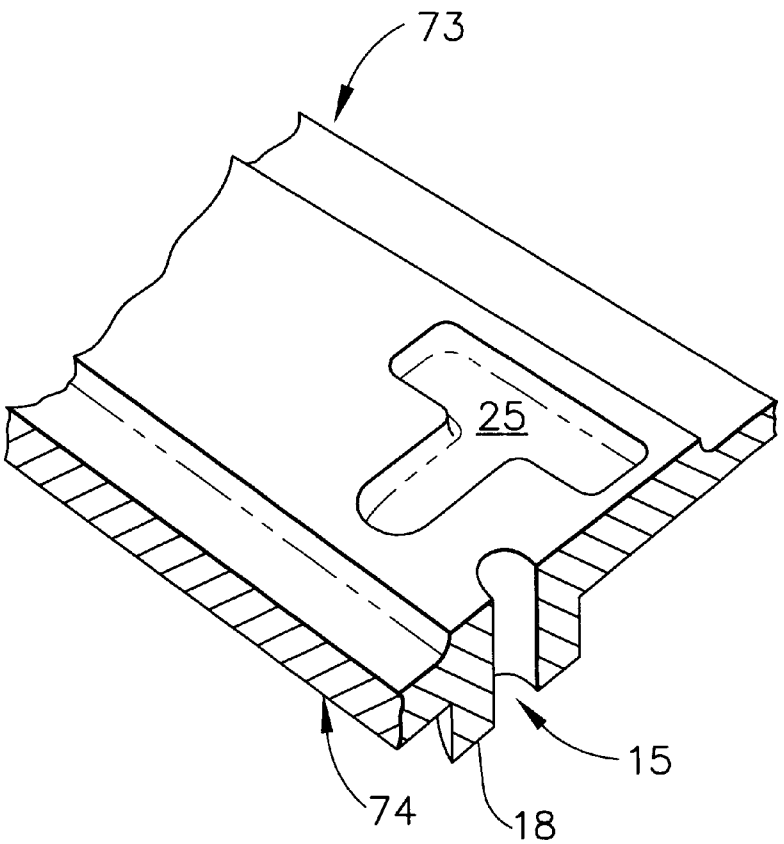
FIGS. 7 and 8 illustrate differences in cross-sectional geometries, by comparing the apparatus of FIGS. 1 and 4.
Figure 7:
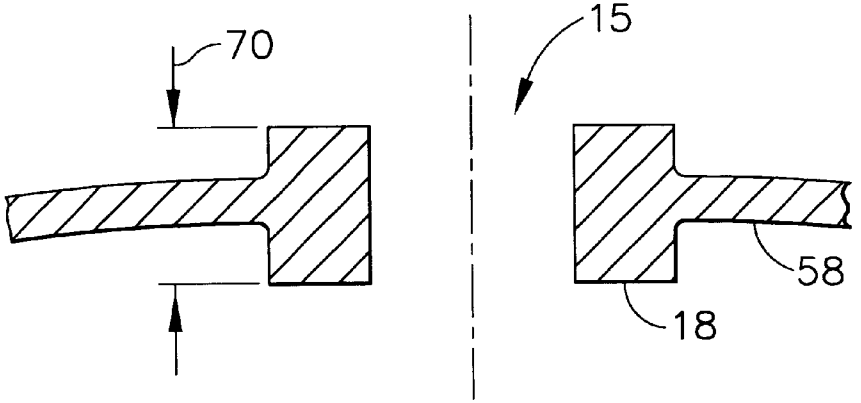
FIG. 7 (PRIOR ART)

In addition, in FIG. 4, the overall thickness of the material surrounding an aperture 15, can be the same as that in FIGS. 1 and 2. FIGS. 7 and 8 represent this thickness.

FIG. 7 represents the situation of FIG. 1, and shows a boss 18 which is symmetrical about casing 58. FIG. 8 represents one form of the invention. T-slot 25 is shown in the inner surface, or inner side, 73 of the case, while boss 18 is shown on the outer surface, or side, 74. Boss 18 lacks the symmetry of FIG. 7

Definitions will be given for several terms, partly to assist characterizations of the invention which will follow. Other definitions are possible.

Axis 80 in FIG. 6 defines the axial direction. Arrows 85 represent the circumferential direction. Arrows 90 represent the radial direction. The apertures 15 in FIGS. 1, 5, and 8 can thus be termed radially facing.

One type of numerical relationship between the number of T-slots and the number of apertures 15 will be examined. In FIG. 4, the two T-slots 25 can be viewed as defining a sector 55. If this sector is taken as covering 30 degrees, then 12 such sectors would be found in the overall case, to cover 360 degrees. Restated, 12 T-slots 25, evenly spaced over the case, would divide the case into 12 sectors.

The sector 55 shown in FIG. 4 contains 3 primary apertures 15. Secondary apertures or holes 105 are also shown, and they are used to attach threaded fasteners to connect external components such as flanges for tubing, such as fuel lines, or sensors. The 12 sectors as shown in FIG. 6 would contain 36 primary apertures 15. Thus, if "T" represents the total number of T-slots around the circumference of the inner face 30 of the casing and "N" represents the total number of primary apertures 15 around the circumference of the inner face 30 of the casing, the ratio, T/N, of T-slots 25 to primary apertures 15 is 12/36, or 1/3.

In another form of the invention, another numerical relationship will be examined. The sector shown in FIG. 4 also contains boss 56, which is formed by the 2 T-slots 25 and contains one primary aperture 15 and 3 secondary apertures 105. Using the same methodology as before, this boss 56 can be said to be an 18 degree sector, thus the number of such bosses 56 and bosses 55 would be used around the circumference as appropriate to accommodate the requirement for apertures for the overall case to cover 360 degrees. Restated, the overall number T of T-slots 25, spaced over the case would divide the case into sectors containing a number N of primary apertures in sectors 55 or 56, so that the ratio of T/N does not equal 1. The invention contemplates using any number of bosses appropriate to the stress relief requirement for a required number of apertures for any particular application. For example, a boss could be formed around any number of apertures between a pair of adjacent T-slots, and an adjacent boss could be provided for any other number of apertures. The resulting casing could include a combination of T-slots forming bosses each of which contains more than one aperture or any combination of T-slots to provide stress relief for bosses needed to strengthen the region surrounding the apertures. The invention is defined in that at least one of the bosses contains either no aperture or more than one aperture, so that the total number of stress relief slots T around the circumference of the casing is not equal to the total number of apertures through the casing.

Thus, the number of bosses needed to dissipate the stress due to the 36 primary apertures 15 is less than the number of apertures themselves, compared with the situation of FIGS. 1 and 2.

In addition, if the sector under consideration is viewed as containing a single boss which serves multiple primary apertures 15, that single boss also contains multiple sets of secondary apertures, each set corresponding to a primary aperture 15.

From another perspective, the single boss can be viewed as cooperating with its neighbor (not fully shown) to form the T-slot 25 in FIG. 4. The edges 94 of the bosses cooperate to form, and define, the T-slot 25.

The invention presents the benefit of providing the needed stress dissipation, yet eliminating the need to construct individual bosses for each aperture on the inner surface of the case, as in FIG. 2. Further, each T-slot 25 can be constructed as shown in FIG. 5, using a pair of straight-line milling cuts: one for the stem 95, or vertical part, of the T, and one for the bar 98, or horizontal part, of the T.

Of course, multiple passes can be taken, so that each pass need only take a shallow cut, such as one, or a few, mils in depth. Since the stem 95 of the T is aligned generally axially, one set of passes is taken in the axial direction. Since the bar 98 of the T is aligned generally circumferentially, one set of passes is taken in the circumferential direction.

In one form of the invention, the stem 95 and bar 98 of the T need not be conjoined to each other, but can be positioned apart from each other. That is, a circumferential array of generally axially aligned stems is provided, and a separate circumferential array of generally circumferentially aligned bars is also provided.

In one form of the invention, the normal boss structure of FIG. 1 is maintained on the outer surface of the case. However, on the inner surface, as in FIG. 4, no bosses are present, except for those defined by the T-slots 25. The T-slots 25 in FIGS. 4 and 6 are contained in an annulus 99, which also contains apertures 15.

Figure 9:
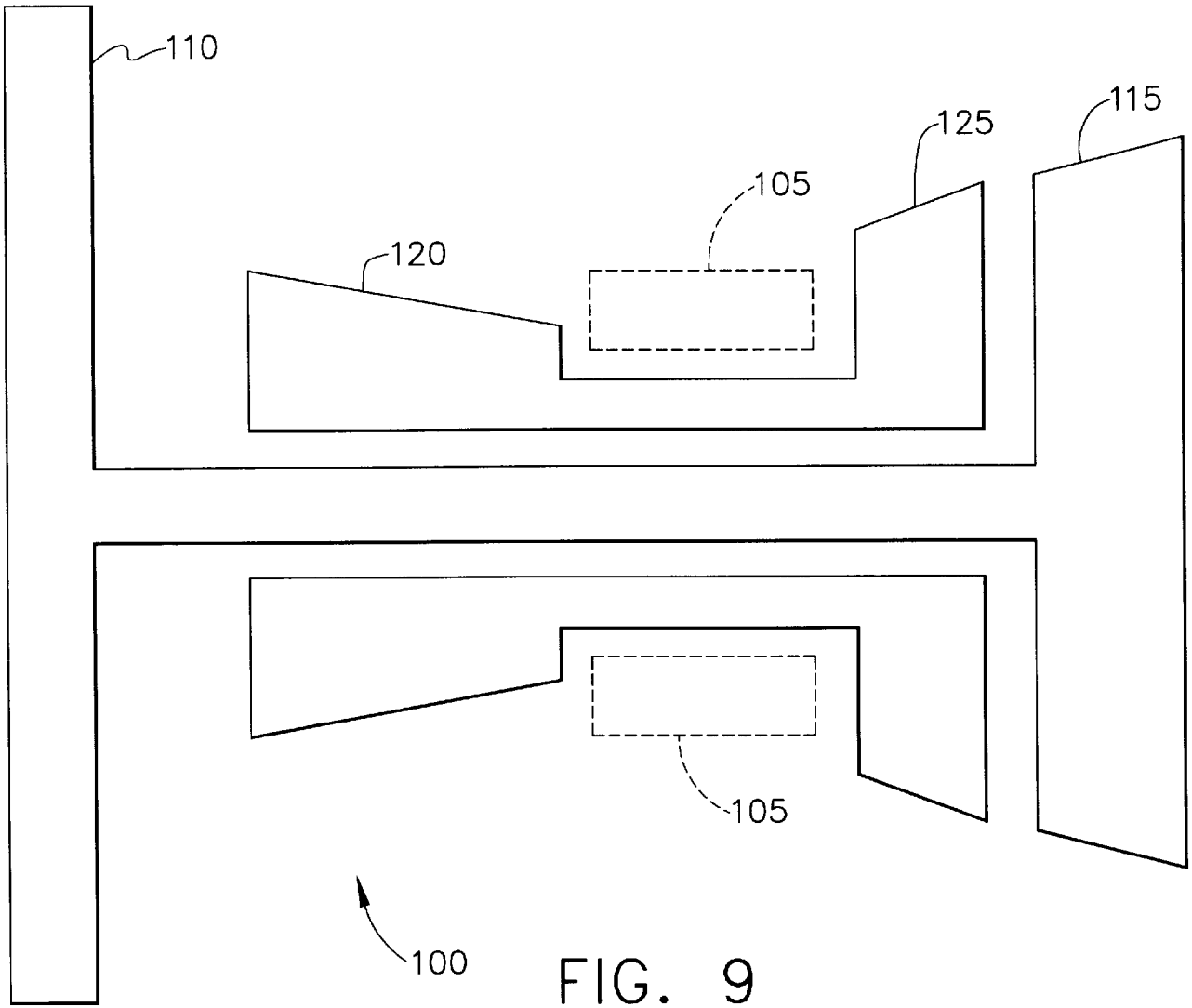
FIG. 9 schematically illustrates a gas turbine engine utilizing one form of the invention.

FIG. 9 illustrates one form of the invention. A gas turbine engine 100 contains the combustor case 105, which is configured with T-slots 25 as described above. The engine 100 includes a fan 110, low pressure turbine 115, high pressure compressor 120, and a high pressure turbine 125.

Numerous substitutions and modifications can be undertaken without departing from the true spirit and scope of the invention. For example, the embodiments described herein have been framed in the context of a gas turbine aircraft engine. However, the invention can be used in casings used in electrical power generation equipment, and such casings, in many instances, are much thicker than those used in aircraft engines.

What is desired to be secured by Letters Patent is the invention as defined in the following claims:

1. A method, comprising the steps of:

a) operating a generally cylindrical or conical gas turbine combustion case which contains apertures; and b) dissipating stresses by maintaining an array of T-shaped slots on a surface of said case, with no bosses for individual apertures on said surface.

2. A system for a gas turbine engine, comprising:

a) a generally cylindrical or conical combustion case;

b) a number, N, of primary apertures in the combustion case; and c) a number, T, of T-shaped slots distributed among the primary apertures, wherein T is not equal to N.

3. System according to claim 2, wherein the primary apertures generate concentrations of stress, and material bounded by the T-shaped slots dissipate at least some of the stress.

4. System according to claim 3, wherein the T-shaped slots are distributed on an inner surface of the case, and no bosses surround individual primary apertures on said inner surface.

5. System according to claim 4, wherein, on an outer surface of the case, a boss surrounds each primary aperture.

6. System according to claim 2, and further comprising an array of secondary apertures associated with each primary aperture, the secondary apertures being usable for attaching a flange which supports a tube or sensor which communicates with the primary aperture.

7. System according to claim 5, and further comprising an array of secondary apertures surrounding each primary aperture, the secondary holes being contained within the boss.

8. A system, comprising:

a) a gas turbine engine which includes a combustion case;

b) an annulus defined within the combustion case which i) contains apertures extending from an inner side to an outer side;

ii) bosses surrounding individual apertures on the outer side;

iii) no bosses surrounding individual apertures on the inner side; and iv) a T-shaped slot on the inner side between at least one pair of individual apertures.

9. A system, comprising:

a) a gas turbine engine which includes a combustion case;

b) an annulus defined within the combustion case which i) contains apertures extending from an inner side to an outer side;

ii) bosses surrounding individual apertures on the outer side; and iii) no bosses surrounding individual apertures on the inner side, wherein multiple apertures are contained within a single boss on the inner side.

10. A system, comprising:

a) a gas turbine engine which includes a combustion case;

b) an annulus defined within the combustion case which i) contains apertures extending from an inner side to an outer side;

ii) bosses surrounding individual apertures on the outer side; and iii) no bosses surrounding individual apertures on the inner side, wherein the inner side contains T-shaped slots, which do not fully penetrate the combustion case.

11. System according to claim 10, wherein said T-shaped slot comprises i) a stem which is aligned axially with the combustion case and ii) a bar which is aligned circumferentially with the combustion case.

12. A method of constructing an annular combustion case, having inner and outer faces, for a gas turbine engine, comprising:

a) constructing apertures in the case;

b) on the outer face of the case, surrounding each aperture with a respective boss; and c) on the inner face of the case, surrounding multiple apertures with a single boss.

13. Method according to claim 12, and further comprising the step of:

a) forming multiple bosses on the inner face, which are separated by T-shaped slots, which slots do not fully penetrate the case.

14. A method of constructing an annular combustion case, having inner and outer faces, for a gas turbine engine, comprising:

a) constructing apertures in the case;

b) on the outer face of the case, surrounding each aperture with a respective boss;

c) maintaining the inner face of the case in a smooth cylindrical shape; and d) disrupting smoothness of the inner face by forming periodic T-shaped slots in the inner face.

15. A combustion case having inner and outer faces for a gas turbine engine, comprising:

a) an annulus having radially facing holes extending therethrough;

b) on the outer face of the annulus, individual bosses surrounding individual holes;

c) on the inner face of the annulus, a plurality of bosses i) each of which surrounds two, or more, holes; and ii) adjacent pairs of which have edges which cooperate to define T-shaped depressions in the inner face.

16. Case according to claim 15, wherein each T-shaped depression comprises a) a stem aligned generally axially with the case; and b) a bar aligned generally circumferentially.

17. A system, comprising:

a) a gas turbine engine; and b) a combustion case which includes an annular body comprising i) an inner surface and an outer surface ii) primary apertures extending through the body, from the inner surface to the outer surface;

iii) bosses on the outer surface surrounding primary apertures;

iii) no bosses on the inner surface which surround individual primary apertures; and iv) a plurality of T-shaped slots penetrating the inner surface, but not extending through to the outer surface.

18. A system, comprising:

a) a gas turbine engine; and b) an annular combustion case which includes i) an inner surface and an outer surface;

ii) a plurality of T-slots on the inner surface, with adjacent T-slots being separated by a respective space;

iii) in every space except a unique space, a single aperture extending from the inner surface to the outer surface; and iv) in the unique space, either no aperture, or more than one aperture.

19. A system, comprising:

a) a gas turbine engine; and b) an annular combustion case which includes i) an inner surface and an outer surface;

ii) N slots

A) which are T-shaped,

B) which are distributed along a circumferential band on the inner surface, and

C) of which, every adjacent pair defines a space therebetween, thereby defining a total of N spaces;

iii) in each space except the Nth space, a single aperture which extends from the inner surface to the outer surface; and iv) in the Nth space, a n umber of apertures other than one.

20. System according to claim 19, wherein the number of apertures in the Nth space is zero.

* * * * *